United States Patent [19]

Costello

[11] 4,061,802

[45] Dec. 6, 1977

[54] PLATING PROCESS AND BATH

[76] Inventor: Francis E. Costello, 7 Madison Ave., Laurel Springs, N.J. 08084

[21] Appl. No.: 647,001

[22] Filed: Jan. 7, 1976

Related U.S. Application Data

[63] Continuation of Ser. No. 588,725, Oct. 24, 1966, abandoned, and a continuation-in-part of Ser. No. 504,192, Oct. 23, 1965, abandoned.

[51] Int. Cl.[2] ..... C23C 3/02

[52] U.S. Cl. ..... 427/304; 427/306; 106/1.27; 427/430 A

[58] Field of Search ..... 427/304, 306, 430; 106/1

[56] References Cited

U.S. PATENT DOCUMENTS

| | | | |
|---|---|---|---|
| 2,532,283 | 12/1950 | Brenner | 106/1 |
| 3,148,072 | 8/1964 | West et al. | 106/1 |
| 3,212,917 | 10/1965 | Tsu et al. | 427/306 |
| 3,212,918 | 10/1965 | Tsu et al. | 427/306 |
| 3,441,428 | 4/1969 | Reinhard et al. | 427/306 |

*Primary Examiner*—Ralph S. Kendall

*Attorney, Agent, or Firm*—Smith, Harding, Earley & Follmer

[57] ABSTRACT

An electroless nickel bath for applying a nickel coating to articles without heat distortion, especially plastic articles, comprising water, nickel ions, a reducing agent for reducing the nickel ions to a metal, and a stabilizing agent for controlling the operating speed of the reducing agent, the bath being maintained at an alkaline pH, with the weight of the nickel ions being less than the weight of the hypophosphite anions. The nickel ions may be obtained from nickel salts, the reducing agent may be sodium hypophosphite, and the stabilizing agent may be sodium citrate and ammonium chloride. A replenish mixture for maintaining the bath comprising nickel ions and reducing agent anions in about the same ratio as in the original bath, and a stabilizing agent in about one-third the amount as in the original bath. A method of applying a nickel coating to articles comprising immersing the articles in said electroless nickel bath at room temperature.

43 Claims, No Drawings

PLATING PROCESS AND BATH

This is a continuation-in-part of my application Ser. No. 504,192, filed Oct. 23, 1965, now abandoned, and is a continuation of my application Ser. No. 588,725 filed Oct. 24, 1966, now abandoned.

This invention relates to plating, and more particularly concerns the plating of plastic articles. The invention relates to plating by chemical reduction, and concerns a method and bath for the electroless plating of surfaces with a metallic coating such as nickel by catalytic chemical reduction reaction.

It has previously been proposed to provide a process and bath for applying a nickel coating to plastic articles and then electroplating the articles with copper, or chrome, or other plating material. Plated articles having a plastic base are superior to plated articles having a metal base from the standpoint of corrosion resistance, because the plastic resists attack by corrosive atmospheres whereas the metal base does not.

However, previously proposed nickel coating baths and methods have a number of disadvantages. One such bath has to be operated at high temperatures so that the plastic distorted and did not retain its shape. Also it produces an end product which is blotchy. It operates inconsistently, in a hit or miss fashion, and produces articles which may or may not pass inspection.

Another prior art method produces articles which have a nickel coating, but the nickel is in a passive state (difficult to electrodeposit an adherent metallic coating), and the surface must be activated to accept an adherent electrodeposit of metal by dipping the articles in a 50% sulphuric acid bath at about 140° F for about 2 minutes prior to being immersed in an electroplating bath.

U.S. Pat. No. 1,207,218 which issued on Dec. 5, 1916 to Roux discloses a process which produces the deposition of nickel coatings by a hypophosphite. However, his bath decomposed spontaneously to yield a coating on all objects immersed in it, including the walls of the vessel.

U.S. Pat. No. 2,532,283 was issued to Brenner and Riddell on Dec. 5, 1950 and discloses an electroless plating process which differed from Roux's deposition of nickel in that the Roux reaction was spontaneous and complete, whereas the Brenner et al. process was a catalytic process so controlled that deposition occurred only on catalytic surfaces immersed in the bath. However, in the Brenner et al process the hypophosphite becomes converted into phosphite, and when the bath becomes too concentrated with the phosphite, the bath is discarded. It is more economical to discard the bath than to try to remove the phosphite.

Accordingly, it is an object of this invention to provide a process and bath which are more stable and less expensive than the prior art.

It is another object to apply a metallic coating to articles at a faster rate of deposition than that obtained by the prior art.

It is another object to provide a process and bath for placing an adherent electrically conductive coating on a plastic article so that it can be plated by standard electroplating methods, and thereby plated with copper, nickel, chrome, silver, or other plating materials.

It is another object to provide a process and bath for coating articles, which process and bath operate at room temperatures, so as to apply a metallic coating onto articles without heat distorting them and to make unnecessary the special equipment, such as stainless steel components, which are needed in baths that operate at elevated temperatures.

Other objects and advantages of this invention, including its simplicity and economy, will become apparent hereinafter from the following description and claims.

In practicing the process of this invention, a "starter" or "initial" bath is made at the beginning of the nickel coating operation. As the articles are being coated, the composition of the bath changes and this stage of the bath is referred to herein as the "operating" bath. The operating bath is restored to the condition of the starter bath by adding a replenishing solution which restores the volume and proportions of constituents of the operating bath to approximately the same as they were in the starter bath.

By ounces as used herein is meant avoirdupois ounces.

An electroless nickel bath in accordance with the invention for applying a nickel coating to articles at low temperatures so that the articles do not distort from heat comprises water, nickel ions, a reducing agent for reducing the nickel ions to metal to coat articles immersed in the bath at a temperature below the distortion temperature of the articles, and a stabilizing agent for controlling unwanted precipitation in the bath. The reducing agent is a room temperature reducing agent adapted to coat the articles while the bath is maintained at room temperature, and may be sodium hypophosphite. The nickel ions may be obtained from a nickel salt dissolved in the solution, and the ratio of sodium hypophosphite to the nickel ions by weight is about 4.4 to 1, advantageously.

Another nickel bath in accordance with the invention comprises nickel sulphate, nickel chloride, a reducing agent for reducing the nickel ions to a metal, a stabilizing agent for stabilizing the bath and for controlling the operating speed of the reducing agent, and water.

The nickel sulphate and nickel chloride may be present in the ratio of about 3 to 8, respectively, and in a range per gallon of bath of 1⅝ to 6 oz. of nickel sulphate and 4 to 16 oz. of nickel chloride, but the preferred quantities are 3¼ oz. of nickel sulphate and 8 oz. of nickel chloride.

The reducing agent may be any hypophosphite, but preferably is sodium hypophosphite because it is readily available and is relatively inexpensive. The sodium hypophosphite may be present in a range of 4 to 24 oz. per gallon of solution, but preferably is 12 oz. per gallon.

The stabilizing agent may be any one of a number of such agents, but I prefer sodium citrate and ammonium chloride. These stabilizing agents are advantageously used in my alkaline nickel bath. The sodium citrate and ammonium chloride are present in about equal quantities but preferably in a ratio of about 19 to 13, respectively, and in a range, per gallon of solution, of 9⅝ to 38½ oz. of sodium citrate and 6¾ to 27 oz. of ammonium chloride.

The bath is alkaline and preferably is operated at a pH of at least 8.5. The bath may be brought to this pH by adding ammonium hydroxide, for example. Per gallon of solution, there may be 160 to 640 cc. of ammonium hydroxide but preferably there is 320 cc.

If desired, ammonium hypophosphite may be substituted for the sodium hypophosphite and ammonium hydroxide.

To further illustrate the invention, a number of examples will be given.

EXAMPLE 1

The initial bath for applying a nickel coating to articles of plastic is made in a 30 gallon batch. The composition of the starter bath is as follows:

water: 22½ gal.
nickel sulphate: 97½ oz.
nickel chloride: 240 oz.
sodium citrate: 575½ oz.
ammonium chloride: 405 oz.
sodium hypophosphite: 360 oz.
ammonium hydroxide: 9600 cc.

The composition of this starter bath per gallon of solution is:

water: ¾ gal.
nickel sulphate: 3¼ oz.
nickel chloride: 8 oz.
sodium citrate: 19¼ oz.
ammonium chloride: 13½ oz.
sodium hypophosphite: 12 oz.
ammonium hydroxide: 320 cc.

The ammonium hydroxide is sufficient in amount to bring the pH of the solution to at least 8.5.

EXAMPLE 2

Another starter bath in accordance with the invention which was found to give beneficial results is as follows, on a per gallon of solution basis.

water: ¾ gal.
nickel sulphate: 1⅝ oz.
nickel chloride: 4 oz.
sodium citrate: 9⅝ oz.
ammonium chloride: 6¾ oz.
sodium hypophosphite: 4 oz.
ammonium hydroxide: 160 cc.

EXAMPLE 3

Another starter bath in accordance with the invention is as follows:

water: ¾ gal.
nickel sulphate: 6½ oz.
nickel chloride: 16 oz.
sodium citrate: 38½ oz.
ammonium chloride: 27 oz.
sodium hypophosphite: 24 oz.
ammonium hydroxide: 640 cc.

EXAMPLE 4

The range of ingredients which make up the starter bath of the invention may be stated to be as follows, for example:

water: ¾ gal.
nickel sulphate: 1⅝ - 6½ oz.
nickel chloride: 4 - 16 oz.
sodium citrate: 9⅝ - 38½ oz.
ammonium chloride: 6¾ - 27 oz.
sodium hypophosphite: 6 - 24 oz.
ammonium hydroxide: 160 - 640 cc.

SUBSTITUTIONS

It will be realized that various ingredients may be substituted for the ingredients listed in the foregoing examples, and the following examples illustrate such substitutions.

EXAMPLE 5 nickel sulphate ($NiSO_4.6H_2O$): gr 25.0
nickel chloride ($NiCl_2.6H_2O$): gr 60.0
sodium citrate ($Na_3C_6H_5O_7.2H_2O$): gr 144.0
ammonium chloride ($NH_4Cl$): gr 101.25
sodium hypophosphite ($NaH_2PO_2.H_2O$): gr 90.0

The pH of the bath was brought to 8.5 by adding 85 ml of ammonium hydroxide ($NH_4OH$), sufficient water was added to bring the solution to 1 liter, and the bath was maintained at room temperature (about 68° F). The nickel metal ion concentration is about 2.7 oz/gal or 20.52 g/l.

EXAMPLE 6

The bath was the same as Example 5, except that 25.0 gr. of nickel chloride was substituted for the nickel sulphate.

EXAMPLE 7

The bath was the same as Example 5, except that 60.0 gr. of nickel sulphate was substituted for the nickel chloride.

EXAMPLE 8

The bath was the same as Example 5, except that 40.9 g/l of nickel carbonate ($NiCO_3$) was substituted for the nickel sulphate and nickel chloride, and 192.3 g/l of citric acid ($H_3C_6H_5O_7$) was substituted for the sodium citrate. The bath was maintained at a temperature of 125° F, and the pH was 8.8.

EXAMPLE 9

The bath was the same as Example 5, except that 86 g/l of nickel acetate ($Ni(C_2H_3O_2)_2.4H_2O$) was substituted for the nickel sulphate and nickel chloride. The temperature was maintained at room temperature, 78° F, and the pH was 8.7.

EXAMPLE 10

The bath was the same as Example 5, except that 135 ml/l of nickel sulfamate ($Ni(SO_3.NH_2)_2$) was substituted for the nickel sulphate and nickel chloride, sufficient ammonium hydroxide was added to adjust the pH to 8.5, and the temperature was maintained at room temperature, 76° F.

EXAMPLE 11

The bath was the same as Example 5, except that 166.6 ml/l of 30% phosphorus acid ($H_3PO_2$), i.e., 56 g/l, was substituted for the sodium hypophosphite, and sufficient ammonium hydroxide was added to the solution to adjust the pH to 8.5. The temperature was at room temperature, 78° F.

EXAMPLE 12

The bath was the same as Example 5, except that 158.4 g/l of potassium citrate ($K_3C_6H_5O_7.H_2O$) was substituted for the sodium citrate, sufficient ammonium hydroxide was added to the solution to adjust the pH to 8.7, and a temperature of 112° F was maintained.

EXAMPLE 13

The bath was the same as Example 5, except that 160 g/l of Rochelle salts ($KNaC_4H_4O_6.4H_2O$) was substituted for the sodium citrate, sufficient ammonium hydroxide was added to adjust the pH to 8.6, and the temperature was maintained at 120° F. A very rapid deposit of nickel was noted, and the plastic articles did not distort from heat.

EXAMPLE 14

The bath was the same as Example 5, except that 110.56 g/l of sodium chloride (NaCl) was substituted for the ammonium chloride, sufficient ammonium hydroxide was added to maintain the pH at 8.5, and the solution was maintained at room temperature, 74° F.

EXAMPLE 15

The bath was the same as Example 5, except that 141.0 g/l of potassium chloride (KCl) was substituted for the ammonium chloride, sufficient ammonium hydroxide was added to maintain the pH at 8.5, and the temperature of the bath was maintained at room temperature, 72° F.

EXAMPLE 16

The bath was the same as Example 5, except that 180.0 g/l of magnesium chloride ($MgCl_2$) was substituted for the ammonium chloride, sufficient ammonium hydroxide was added to maintain the pH at 8.5, and the temperature was maintained at room temperature, 78° F.

EXAMPLE 17

The bath was the same as Example 5, except that sodium hydroxide (NaOH) was used to adjust the pH to 8.5, instead of using ammonium hydroxide, and the temperature of the bath was maintained at room temperature, 70° F. The amount of sodium hydroxide used was 17.6 g/l.

EXAMPLE 18

The bath was the same as Example 5, except that the pH of the bath was adjusted to 8.5 by potassium hydroxide (KOH) instead of the ammonium hydroxide. In this bath, 24.7 g/l of potassium hydroxide was used, and the temperature was maintained at room temperature, 75° F.

CONCENTRATIONS

The concentrations of the ingredients of the bath may be varied, and the following examples are illustrative thereof, and give satisfactory results in depositing nickel coatings.

EXAMPLE 19 nickel sulphate: gr 31.8
nickel chloride: gr 76.2
sodium citrate: gr 183.0
ammonium chloride: gr 129.0
sodium hypophosphite: gr 114.0

Sufficient ammonium hydroxide was added to adjust the pH to 9.5, water was added to bring the solution to 1 liter, and the temperature of the bath was maintained at 142° F.

EXAMPLE 20

The bath was the same as Example 5, except that the solution was diluted by adding 1 liter of water per liter of solution of Example 5, thus reducing the nickel ion concentration to 10.24 g/l, or 1.35 oz/gal.

EXAMPLE 21

The bath was the same as Example 20, except that the solution was diluted by adding 1 liter of water per liter of solution of Example 20, thus reducing the nickel ion concentration to 5.12 g/l, or 0.675 oz/gal.

EXAMPLE 22

The bath was the same as Example 21, except that the solution was diluted by adding 1 liter of water per liter of solution of Example 21, thus reducing the nickel ion concentration to 2.56 g/l, or 0.338 oz/gal.

EXAMPLE 23

The bath was the same as Example 22, except that the solution was diluted by adding 1 liter of water per liter of solution of Example 22, thus reducing the nickel concentration to 1.28 g/l, or 0.169 oz/gal.

pH

The pH of the bath may be varied and the following examples illustrate such variations.

EXAMPLE 24

The bath was the same as Example 5, except that the pH was reduced to 7.5 by using less ammonium hydroxide, and the room temperature was 80° F.

EXAMPLE 25

The bath was the same as Example 24, except that the pH was 7.0 because less ammonium hydroxide was used.

EXAMPLE 26

The bath was the same as Example 24, except that the pH was increased to 10 by adding more ammonium hydroxide.

REPLENISH SOLUTION

During the operation of the bath, the ingredients are depleted. The nickel is deposited on the articles, and some ingredients are lost through dragout, i.e., some of the ingredients remain on the articles when they are lifted from the bath and are dragged out of the bath.

Accordingly, after operation of the bath for some time, I bring the ingredients back to the full strength of the starter bath by adding a replenish solution to the operating bath. I prefer to add this replenish solution after the bath has nickel coated about 125 square feet of articles per gallon of bath solution.

EXAMPLE 27

A replenish solution for maintaining the nickel bath may have the following ingredients and ratios:

water: ⅞ gal.
nickel sulphate: 3¼ oz.
nickel chloride: 8 oz.
sodium citrate: 6½ oz.
ammonium chloride: 4½ oz.
sodium hypophosphite: 12 oz.
ammonium hydroxide: sufficient to bring the pH of the solution to 8.5.

EXAMPLE 28

Another replenish solution which was found satisfactory is as follows:

nickel sulphate: 3¼ oz.
nichel chloride: 8 oz.
sodium citrate: 1.9 oz.
ammonium chloride: 1.3 oz.
sodium hypophosphite: 12 oz.

ammonium hydroxide: sufficient to bring the pH of the solution to 8.5.

water: suffficient to bring the solution to 1 gallon.

It is to be noted that the nickel salts and the sodium hypophosphite in the replenish solution are at full starter-bath strength because these ingredients are lost by reduction in the process, whereas the complexing agents, sodium citrate and ammonium chloride, are at about 10% of the starter bath strength, since these ingredients are lost during the process only through drag-out.

The replenish solution for replenishing an electroless nickel starter bath including water, nickel ions, a reducing agent for reducing the nickel ions to metal to coat articles immersed in the bath at a temperature below the heat distortion temperature of the articles, and a stabilizing agent for controlling unwanted precipitation in the bath, in general comprises water, nickel ions, a reducing agent, and a stabilizing agent for controlling unwanted precipitation in the bath, with the quantity per liter of the replenishing nickel ions and reducing agent being about the same as the starter bath nickel ions and reducing agent, and the quantity per liter of the replenishing stabilizing agent being about one-tenth to one-third of the starter bath stabilizing agent.

It will be realized that the operating bath need not be restored to the composition of the starter bath by replenishing it with a solution, since the operating bath may be replenished by adding ingredients in salt form. However, replenishing by adding a solution is preferred because of simplicity and the ease with which this may be done by unskilled personnel.

Sodium hypophosphite does not generally act as a reducing agent below a temperature of about 110° F. However, the ammonium hydroxide in the bath acts upon the sodium hypophosphite so that it operates at room temperature, thus enabling the electroless nickel bath to operate at room temperature.

One of the big advantages of the bath of this invention is its stability at room temperature. Another advantage is its economy, costing as little as one half cent per square foot of nickel coating on articles as compared with two cents per square foot of coating by an electroless copper process.

The nickel coating may be applied to any type of plastic and the bath will not damage the plastic.

Moreover, articles plated by the inventive bath may be electroplated using amperages up to 80 amps per square foot without burning off the conductive nickel coating.

The present invention eliminates the necessity of first dipping the articles to be electroplated into a strike bath, i.e., an electroplating bath which plates with copper at 5–10 amps per square foot of article, before dipping the article in a high speed electroplating bath with which operates at high current densities such as 40 amps per square foot or over. The conductive nickel deposited on the article by the present invention is so tough that it withstands the high temperatures at the contact areas, generated by the high current densities, in high speed electroplating baths without burning away.

The electroless nickel which is deposited on the plastic articles by the present invention is a non-passive nickel. This means that, without any further preparation steps, you cam immediately plate on it such plating materials as copper or nickel.

THE PROCESS

The process of plating a conductive coating of nickel on an article in accordance with this invention is as follows.

The article to be nickel plated may be a plastic, a non-conductive surface, or it may be a metal, but it will be described with reference to a plastic article.

If the article has a glazed surface, the first step is to roughen the surface to remove the glaze. This may be done by chemically etching the article by dipping it into an etching solution comprising chromic and sulphuric acid at 150° F, or it may be done by roughening the surface of the article by mechanical means.

If the roughening is done by chemical means, the solution is rinsed from the article.

Then the article is dipped into a bath containing palladium chloride which forms a minute film on the plastic article. This bath is a standard bath containing palladium chloride and hydrochloric acid with perhaps some stannous chloride.

Then the article is dipped into an electroless nickel bath of the present invention, the composition of which is previously described. This nickel bath may be operated anywhere between 70° to 150° F. without losing its stability. The higher the temperature, the faster the rate of deposition of the nickel onto the articles. However, the preferred temperature of the bath is about 70 to 85° F.

The articles are left in the bath until a sufficiently thick coating of nickel is deposited thereon. Usually the articles are left in the bath for three minutes if they are racked, and for about five minutes if they are deposited in the bath in bulk form.

The articles are removed from the nickel bath and then plated by depositing them in an electrolytic bath.

To further illustrate the process of the invention, plastic articles made of acrylonitrile-butadiene-styrene (ABS) such as the plating grade of ABS, EP 3510 made by Marbon Chemical Division of Borg-Warner Corporation, Washington, W. Va., were treated as follows.

Etch

The plastic articles were immersed in an etch solution having the following concentrations of ingredients per gallon of solution: 40 to 55 ounces of chromic acid, sufficient 66 Balme commercial grade sulphuric acid to maintain the sulphuric acid concentration at about 12 to 15 normality (about 39 to 49 ounces), and sufficient water to bring the solution to 1 gallon.

A fluoride ion in the range of about from 0.01 to 3.0 oz. per gallon of the solution may be included, and has been found to give beneficial results. The fluoride ion may be introduced by adding hydrofluoric acid or salts thereof; for example, sodium fluoride, ammonium bifluoride, and chromium fluoride.

The etch bath is maintained in a temperature range of between 140° to 155° F, and the articles may be immersed therein for a period of time in the range of about 1 to 8 minutes, with the higher the temperature the shorter the time. The preferred time is about 3 to 5 minutes at 148° F. The articles may be immersed without distortion in the etch bath in bulk up to about the 155° F temperature, and may be immersed on racks up to about 150° F. The purpose of immersing the articles in the etch bath is to remove any glaze and condition the plastic surface to receive a sensitizer coating which is the next step in the process.

To further illustrate the composition of the etch solution, a number of illustrations will be given.

EXAMPLE 29 chromic acid: oz. 40
66 Be sulphuric acid: oz. 39
fluoride ion: oz. 0.01
sufficient water to bring the solution to 1 gal.

EXAMPLE 30 chromic acid: oz. 55
66 Be sulphuric acid: oz. 49
fluoride ion: oz. 3.0
sufficient water to bring the solution to 1 gal.

EXAMPLE 31 chromic acid: oz. 50
66 Be sulphuric acid: oz. 44
fluoride ion: oz. 1.5
sufficient water to bring the solution to 1 gal.

Sensitizer

Next, the articles are taken from the etch bath and immersed in a sensitizer bath of stannous chloride and hydrochloric acid which forms a film of tin on the articles so that they are more readily receptive to receiving a coating of palladium in accordance with the following step of the process, which is immersion in an activator bath. The articles are preferably immersed in the sensitizer bath for about 2 to 5 minutes at room temperature.

Activator

Next, the plastic articles are removed from the sensitizer bath and immersed in an activator bath of palladium chloride and hydrochloric acid solution which puts a very fine film of palladium on the articles. Such an activator solution is described in Brenner et al. U.S. Pat. No. 2,532,283 at column 3, lines 14–17 as a solution of 0.02 gram of palladium chloride ($PdCl_2$) and 20.0 grams of hydrochloric acid per liter of solution. The articles are immersed for about 3 minutes, and may be immersed for a period of time within the range of about 1 to 5 minutes, at room temperature. The concentration of ingredients and the length of the time that the articles may be immersed in the activator bath can be varied inversely; and when the solution is heated, the immersion time may be decreased.

Electroless Nickel Bath

Next, the articles are withdrawn from the activator bath and immersed in an electroless nickel bath in accordance with the present invention.

Electrolytic Bath

The articles are then withdrawn from the electroless nickel bath and are immersed in an electrolytic bath of copper. The nickel coating deposited on the bath in the electroless nickel bath is such that the articles may be subjected to 50 amperes per square foot without burning off the nickel coating. This is an important difference over other processes which require that the nickel coated articles must first be subjected to a strike of 10 to 15 amperes per square foot before the articles can be subjected to the higher amperage.

Combined Sensitizer-Activator

As an alternative to immersing the articles in the sensitizer and activator baths, they may be immersed in a combined sensitizer-activator bath containing a mixture of tin and palladium in solution such as the solution described in Shipley U.S. Pat. No. 3,011,920, issued Dec. 5, 1961. In such a bath, the articles are coated with a film of tin and palladium.

Accelerator

After being coated with a tin-palladium film in the combined sensitizer-activator bath, the articles are removed and are immersed in an accelerator bath which is a dilute acid bath, such as hydrochloric acid, which removes the outer coat of tin so that an outer surface of palladium is unmasked and presented to the electroless nickel bath in the next step of the process.

Rate of Deposition

The rate of deposition of the nickel coating in the electroless nickel bath is very high at temperatures below the temperatures at which ABS plastic distorts from heat. The following examples illustrate this high rate of deposition at various temperatures, with the ABS plastic articles being immersed for 5 minutes. The articles are subjected to the steps of etching, sensitizing, and activating with palladium, before being immersed in one of the following nickel baths.

EXAMPLE 32

The articles are immersed in the bath of Example 5 and the temperature thereof is maintained at a room temperature of 80° F. The nickel coating deposited is 0.000025 inch thick.

EXAMPLE 33

The articles are deposited in the bath of Example 5 and the temperature thereof is maintained at 120° F. The nickel coating deposited on the articles is 0.00036 inch thick.

EXAMPLE 34

The articles are deposited in the bath of Example 5 and the temperature thereof is maintained at 140° F. The nickel coating deposited on the articles is .000858 inch thick.

EXAMPLE 35

The articles are deposited in the bath of Example 6 with the temperature being maintained at room temperature of 80° F. The nickel coating deposited on the articles is 0.00017 inch thick.

EXAMPLE 36

The articles are deposited in the bath of Example 6, but the temperature is maintained at 120° F. The nickel coating deposited on the articles is 0.00029 inch thick.

EXAMPLE 37

The articles are deposited in the nickel bath of Example 6, and the temperature is maintained at 140° F. The nickel coating deposited on the articles is 0.000687 inch thick.

The electroless nickel bath of the present invention deposits an adherent electrically conductive coating on articles of plastic so that they can be plated by standard electroplating methods with such plating materials as copper, nickel, chrome, silver, etc.

Since the inventive bath operates at room or relatively low temperatures, the need for special equipment to withstand elevated temperatures, such as stainless steel tanks, is eliminated.

The electroless nickel bath of the present invention is very stable, and unlike prior baths, the amount of phosphite built up does not affect the bath at room temperature and the bath does not have to be discarded.

While the foregoing specification relates to the electroless plating of surfaces with nickel, it is also applicable to equivalent metal coatings such as cobalt coatings.

I claim:

1. An electroless nickel bath for applying a nickel coating to articles comprising about ¾ gallon of water, about 320 cc. of ammonium hydroxide, about 3¼ ounces of nickel sulphate, about 8 ounces of nickel chloride, about 12 ounces of sodium hypophosphite to provide the reducing agent anions for reducing the nickel ions to a metal and about 19¼ ounces of sodium citrate and about 13½ ounces of ammonium chloride as the stablizing agent for controlling the operating speed of the reducing agent, the bath having a pH of about 8.5, and the ratio by weight of nickel ions to reducing agent anions being about 1 to 2.7.

2. An electroless nickel bath for applying a nickel coating to articles at low temperatures so that the articles do not distort from heat, comprising the following approximate ingredients and ratios per liter of solution, 25.0 gr. of nickel sulphate, 60.0 gr. of nickel chloride, 144.0 gr. of sodium citrate, 101.25 gr. of ammonium chloride, 90.0 of sodium hypophosphite, sufficient ammonium hydroxide to adjust the pH to 8.5, and sufficient water to bring the solution to 1 liter.

3. The bath of claim 2, except that 166.6 ml/l of 30% phosphorus acid ($H_3PO_2$) is substituted for the sodium hypophosphite, and sufficient ammonium hydroxide is added to the solution to adjust the pH to about 8.5.

4. The bath of claim 2, except that 158.4 g/l of potassium citrate ($K_3C_6H_5O_7.H_2O$) is substituted for the sodium citrate, and sufficient ammonium hydroxide is added to the solution to adjust the pH to 8.7.

5. The bath of claim 2, except that 160 g/l of Rochelle salts ($KNaC_4H_4O_6.4H_2O$) is substituted for the sodium citrate, sufficient ammonium hydroxide is added to adjust the pH to 8.6.

6. The bath of claim 2, except that 110.56 g/l of sodium chloride (NaCl) is substituted for the ammonium chloride, and sufficient ammonium hydroxide is added to maintain the pH at 8.5.

7. The bath of claim 2, except that 141.0 g/l of potassium chloride (KCl) is substituted for the ammonium chloride, and sufficient ammonium hydroxide is added to maintain the pH at 8.5.

8. The bath of claim 2, except that 180.0 g/l of magnesium chloride ($MgCl_2$) is substituted for the ammonium chloride, and sufficient ammonium hydroxide is added to maintain the pH at 8.5.

9. The bath of claim 2, except that 17.6 g/l sodium hydroxide (NaOH) is used to adjust the pH to 8.5, instead of ammonium hydroxide.

10. The bath of claim 2, except that the pH of the bath is adjusted to 8.5 by 24.7 g/l potassium hydroxide (KOH), instead of the ammonium hydroxide.

11. The bath of claim 2, including sufficient water to bring the solution to 2 liters, reducing the nickel ion concentration to 10.24 gr. per liter.

12. The bath of claim 2, including sufficient water to bring the solution to 3 liters, reducing the nickel ion concentration to 5.12 gr. per liter.

13. The bath of claim 2, including sufficient water to bring the solution to 4 liters, reducing the nickel ion concentration to 2.56 gr. per liter.

14. The bath of claim 2, including sufficient water to bring the solution to 5 liters, reducing the nickel ion concentration to 1.28 gr. per liter.

15. The bath of claim 2, including sufficient ammonium hydroxide to bring the pH of the water to 7.5.

16. The bath of claim 2, including sufficient ammonium hydroxide to bring the pH of the water to about 7.0.

17. The bath of claim 2, including sufficient ammonium hydroxide to bring the pH of the water to about 10.

18. An electroless nickel bath for applying a nickel coating to articles at low temperatures so that the articles do not distort from heat, comprising the following approximate ingredients and ratios per liter of solution, 84.375 gr. of nickel chloride, 144.0 gr. of sodium citrate, 101.25 gr. of ammonium chloride, 90.0 gr. of sodium hypophosphite, sufficient ammonium hydroxide to adjust the pH to 8.5, and sufficient water to bring the solution to 1 liter.

19. An electroless nickel bath for applying a nickel coating to articles at low temperature so that the articles do not distort from heat, comprising the following approximate ingredients and ratios per liter of solution, 84.375 gr. of nickel sulphate, 144.0 gr. of sodium citrate, 101.25 gr. of ammonium chloride, 90.0 gr. of sodium hypophosphite, sufficient ammonium hydroxide to adjust the pH to 8.5, and sufficient water to bring the solution to 1 liter.

20. An electroless nickel bath for applying a nickel coating to articles at low temperatures so that the articles do not distort from heat, comprising the following approximate ingredients and ratios per liter of solution, 40.9 gr. of nickel carbonate, 192.3 gr. of citric acid, 101.25 gr. of ammonium chloride, 90.0 gr. of sodium hypophosphite, sufficient ammonium hydroxide to adjust the pH to 8.8, and sufficient water to bring the solution to 1 liter.

21. An electroless nickel bath for applying a nickel coating to articles at low temperatures so that the articles do not distort from heat, comprising the following per liter of solution, 86 gr. nickel acetate, 144.0 gr. of sodium citrate, 102.25 gr. of ammonium chloride, 90.0 gr. of sodium hypophosphite, sufficient ammonium hydroxide to adjust the pH to 8.7, and sufficient water to bring the solution to 1 liter.

22. An electroless nickel bath for applying a nickel coating to articles at low temperatures so that the articles do not distort from heat, comprising the following per liter of solution, 135 ml of nickel sulfamate, 144.0 gr. of sodium citrate, 101.25 gr. of ammonium chloride, 90.0 gr. of sodium hypophosphite, sufficient ammonium hydroxide to adjust the pH to 8.5, and sufficient water to bring the solution to 1 liter.

23. An electroless nickel bath for applying a nickel coating to plastic articles at low temperatures so that the plastic articles do not distort from heat, comprising the following approximate ingredients and ratios: 20.52 gr. of nickel ions, 144 gr. of sodium citrate, 101.25 gr. of ammonium chloride, 90 gr. of sodium hypophosphite, sufficient ammonium hydroxide to adjust the pH to 8.5, and sufficient water to place the ingredients into solution.

24. An electroless nickel bath for applying a nickel coating to articles at low temperatures so that the articles do not distort from heat, comprising the following approximate ingredients and ratios per liter of solution, 31.8 gr. of nickel sulphate, 76.2 gr. of nickel chloride, 183.0 gr. of sodium citrate, 129.0 gr. of ammonium chloride, 114.0 gr. of sodium hypophosphite, sufficient ammonium hydroxide to adjust the pH to 9.5, and sufficient water to bring the solution to 1 liter.

25. A replenish solution for maintaining a bath for applying a nickel coating to articles, comprising the following ingredients and ratios, for each gallon of replenish solution about $\frac{7}{8}$ gallons of water, about $3\frac{1}{4}$ ounces of nickel sulphate, about 8 ounces of nickel chloride, about $6\frac{1}{2}$ ounces of sodium citrate, about $4\frac{1}{2}$ ounces of ammonium chloride, and about 12 ounces of sodium hypophosphite.

26. The replenish solution of claim 25 including ammonium hydroxide, the pH of the solution being about 8.5.

27. A replenish solution for maintaining a bath for applying a nickel coating to articles at low temperatures so that the articles do not distort from heat, comprising the following ingredients and ratios, about $3\frac{1}{4}$ ounces of nickel sulphate, about 8 oz. of nickel chloride, about 1.9 ounces of sodium citrate, about 1.3 ounces of ammonium chloride, about 12 ounces of sodium hypophosphite, sufficient ammonium hydroxide to bring the pH of the solution to about 8.5, and sufficient water to bring the solution to about 1 gallon.

28. An electroless nickel process for plating a nickel coating to ABS plastic articles which have a non-conductive surface comprising the steps of etching, sensitizing, and activating the surface of said articles;

immersing said articles in an electroless nickel bath including the following approximate ingredients and ratios per liter of solution, 25.0 gr. of nickel sulphate, 60.0 gr. of nickel chloride, 144.0 gr. of sodium citrate, 101.25 gr. of ammonium chloride, 90.0 gr. of sodium hypophosphite, sufficient ammonium hydroxide to adjust the pH to 8.5, and sufficient water to bring the solution to 1 liter;

maintaining the bath at a temperature below the deformation temperature of the plastic to be plated;

allowing the articles to be plated to remain in the bath until plating to the desired thickness has been achieved; and removing the plated articles from the bath.

29. The process of claim 28, wherein the temperature of the bath is maintained at a room temperature of about 80° F the articles remain immersed in the bath for about 5 minutes, and the nickel coating deposited on the articles is about 0.000025 inch thick.

30. The process of claim 28, wherein the temperature of the bath is maintained at a temperature of about 120° F, the articles remain immersed in the bath for about 5 minutes, and the nickel coating deposited on the articles is about 0.000036 inch thick.

31. The process of claim 28, wherein the temperature of the bath is maintained at a temperature of about 140° F, the articles remain immersed in the bath for about 5 minutes, and the nickel coating deposited on the articles is about 0.000858 inch thick.

32. An electroless nickel process for plating a nickel coating to ABS plastic articles which have a nonconductive surface comprising the steps of etching, sensitizing, and activating the surface of said articles;

immersing said articles in an electroless nickel bath including the following approximate ingredients and ratios per liter of solution, 85.0 gr. of nickel chloride, 144.0 gr. of sodium citrate, 101.25 gr. of ammonium chloride, 90.0 gr. of sodium hypophosphite, sufficient ammonium hydroxide to adjust the pH to 8.5, and sufficient water to bring the solution to 1 liter;

maintaining the bath at a temperature below the deformation temperature of the plastic to be plated;

allowing the articles to be plated to remain in the bath until plating to the desired thickness has been achieved; and removing the plated articles from the bath.

33. The process of claim 32, wherein the temperature of the bath is maintained at a room temperature of about 80° F the articles remain immersed in the bath for about 5 minutes, and the nickel coating deposited on the articles is about 0.000025 inch thick.

34. The process of claim 32, wherein the temperature of the bath is maintained at a temperature of about 120° F, the articles remain immersed in the bath for about 5 minutes, and the nickel coating deposited on the articles is about 0.000036 inch thick.

35. The process of claim 32, wherein the temperature of the bath is maintained at a temperature of about 140° F, the articles remain immersed in the bath for about 5 minutes, and the nickel coating deposited on the articles is about 0.000858 inch thick.

36. A method of applying a nickel coating to plastic articles comprising treating the articles with a solution of water, nickel ions, a reducing agent for reducing the nickel ions to a metal, and a stabilizing agent for controlling the operating speed of the reducing agent, and maintaining the temperature of the solution below about 155° F, said solution including the following ingredients per liter of solution, 25.0 gr. of nickel sulphate, 60.0 gr. of nickel chloride, 144.0 gr. of sodium citrate, 101.25 gr. of ammonium chloride, 90.0 gr. of sodium hypophosphite, sufficient ammonium hydroxide to adjust the pH to 8.5, and sufficient water to bring the solution of 1 liter.

37. A method of applying a nickel coating to plastic articles comprising treating the articles with a solution of water, nickel ions, a reducing agent for reducing the nickel ions to a metal, and a stabilizing agent for controlling the operating speed of the reducing agent, and maintaining the temperature of the solution below about 155° F, said solution including the following ingredients per liter of solution, 84.375 gr. of nickel chloride, 144.0 gr. of sodium citrate, 101.25 gr. of ammonium chloride, 90.0 gr. of sodium hypophosphite, sufficient ammonium hydroxide to adjust the pH to 8.5, and sufficient water to bring the solution to 1 liter.

38. A method of applying a nickel coating to plastic articles comprising treating the articles with a solution of water, nickel ions, a reducing agent for reducing the nickel ions to a metal, and a stabilizing agent for controlling the operating speed of the reducing agent, and maintaining the temperature of the solution below about 155° F, said solution including the following ingredients per liter of solution, 85.375 gr. of nickel sulphate, 144.0 gr. of sodium citrate, 101.25 gr. of ammonium chloride, 90.0 gr. of sodium hypophosphite, sufficient ammonium hydroxide to adjust the pH to 8.5, and sufficient water to bring the solution to 1 liter.

39. A method of applying a nickel coating to plastic articles without heat distortion comprising treating the articles with a bath of water, nickel sulphate, nickel chloride, a reducing agent for reducing the nickel ions to a metal, and a stabilizing agent for controlling the operating speed of the reducing agent, the bath including for each gallon of bath about ¾ gallon of water, about 160 to 640 cc. of ammonium hydroxide, about 1⅝ to 6½ ounces of nickel sulphate, about 4 to 16 ounces of nickel chloride, said stabilizing agent comprising about 9⅝ to 38½ ounces of sodium citrate and about 6¾ to 27 ounces of ammonium chloride, said reducing agent comprising about 4 to 24 ounces of sodium hypophosphite, the pH of the mixture being about 8.5, the ratio by weight of nickel ions to reducing agent anions being about 1 to 2.7, and the temperature of the bath being in the range of 70° to 155° F.

40. A method of applying a nickel coating to plastic articles without heat distortion comprising treating the articles with a bath of water, nickel sulphate, nickel chloride, a reducing agent for reducing the nickel ions to a metal, and a stabilizing agent for controlling the operating speed of the reducing agent, the bath including for each gallon of bath, about ¾ gallon of water, about 320 cc. of ammonium hydroxide, about 3¼ ounces of the nickel sulphate, about 8 ounces of the nickel chloride, said stabilizing agent comprising about 19¼ ounces of sodium citrate and about 13½ ounces of ammonium chloride, and said reducing agent comprising about 12 ounces of sodium hypophosphite, the pH of the mixture being about 8.5, the ratio by weight to nickel ions to reducing agent anions being about 1 to 2.7, and the temperature of the bath being in the range of 70° to 85° F.

41. A method of applying a nickel coating to plastic articles without heat distortion comprising treating the articles with a bath of water, nickel ions, a reducing agent for reducing the nickel ions to a metal, and a stabilizing agent for controlling the operating speed of the reducing agent, and maintaining the temperature of the solution below about 155° F, said bath including about 160 to 640 cc. of ammonium hydroxide, about 1⅝ to 6½ ounces of nickel sulphate, about 4 to 16 ounces of nickel chloride, about 9⅝ to 38½ ounces of sodium citrate, about 6¾ to 27 ounces of ammonium chloride, and about 4 to 24 ounces of sodium hypophosphite.

42. The method of claim 41, including maintaining the temperature of the bath in the range of about 70° to 85° F.

43. A method of applying a nickel coating to plastic articles without heat distortion comprising treating the articles with a bath of water, nickel ions, a reducing agent for reducing the nickel ions to a metal, and a stabilizing agent for controlling the operating speed of the reducing agent, and maintaining the temperature of the solution below about 155° F, said bath including nickel ions equivalent to that contributed by about 1⅝ to 6½ ounces of nickel sulphate and about 4 to 16 ounces of nickel chloride, hypophosphite ions in an amount equivalent to that contributed by 4 to 24 ounces of sodium hypophosphite, said stabilizing agent being equivalent to 9⅝ to 38½ ounces of sodium citrate and about 6¾ to 27 ounces of ammonium chloride, sufficient ammonium ions to make the bath alkaline equivalent to that contributed by about 160 to 640 cc. of ammonium hydroxide, and sufficient water to place the other ingredients into solution.

* * * * *